US005516104A

United States Patent [19]

Takemoto et al.

[11] Patent Number: 5,516,104

[45] Date of Patent: May 14, 1996

[54] SLOT MACHINE AND GAME MEDIA DISPENSING APPARATUS

[75] Inventors: Takatoshi Takemoto; Kazunari Kawashima; Masayuki Tsurumi, all of Tokyo; Eiji Ito; Katsuhiro Naito, both of Hanamaki, all of Japan

[73] Assignee: Kabushiki Kaisha Ace Denken, Japan

[21] Appl. No.: 217,311

[22] Filed: Mar. 24, 1994

[30] Foreign Application Priority Data

Mar. 25, 1993 [JP] Japan ..... 5-066412
Apr. 15, 1993 [JP] Japan ..... 5-088509

[51] Int. Cl.[6] ..... A63F 1/00

[52] U.S. Cl. ..... 273/138 A; 27.3/121 R; 27.3/121 D; 27.3/121 B; 27.3/119 R

[58] Field of Search ..... 273/138 A, 121 B, 273/118 A, 119 A, 120 A, 121 A, 121 R, 121 D, 143 A, 126 A

[56] References Cited

U.S. PATENT DOCUMENTS

| | | | |
|---|---|---|---|
| 4,161,314 | 7/1979 | Kaga | 273/121 R |
| 4,726,586 | 2/1988 | Shelton et al. | 273/125 A |
| 5,016,879 | 5/1991 | Parker et al. | 273/126 A |
| 5,120,060 | 6/1992 | Parker et al. | 273/138 A |
| 5,277,424 | 1/1994 | Wilms | 273/85 CP |
| 5,342,049 | 8/1994 | Wichinsky et al. | 273/119 R |

FOREIGN PATENT DOCUMENTS

| | | | |
|---|---|---|---|
| 0037133 | 3/1977 | Japan | 273/121 D |
| 52-52729 | 4/1977 | Japan | 273/121 D |
| 3-68382 | 3/1991 | Japan . | |
| 4073076 | 3/1992 | Japan | 273/138 A |
| 2218558 | 11/1989 | United Kingdom | 273/138 A |

*Primary Examiner*—Vincent Millin
*Assistant Examiner*—Kerry Owens
*Attorney, Agent, or Firm*—Andrus, Sceales, Starke & Sawall

[57] ABSTRACT

A slot machine which uses pachinko balls as game media. It stores in a memory the number of pachinko balls (unit number) economically equivalent to a medal. During take in of pachinko balls for starting a game and dispensing of pachinko balls as prizes, pachinko balls corresponding to an integral multiplication of the unit number are handled. When the unit number is changed, it can be easily accomplished by a change in a value of the unit number using the change instruction inputting apparatus. In the slot machine, the sprocket which controls the dispensing of the pachinko balls and the ratchet wheel are preferably set on the same axis and disengageably linked by a fixing projection and a fixing concave provided on them for conjoint rotation when required.

24 Claims, 16 Drawing Sheets

SLOT MACHINE AND GAME MEDIA DISPENSING APPARATUS

BACKGROUND OF THE INVENTION

1. Field of the Invention

This invention relates to a slot machine which uses pachinko balls as game media. This invention also relates to a pachinko ball dispensing or paying-out machine for paying-out a certain number of pachinko bails as a prize or repaying pachinko balls unused when a game is over.

2. Description of the Related Art

A slot machine which uses pachinko bails as game media has been proposed and used in a game parlor. In this kind of a slot machine, the economical value of a medal, which has previously been used as a game medium, and that of a pachinko ball are not considered to be equal. Thus, when using the pachinko balls as the game media, the number of pachinko bails corresponding to one game, which costs one medal, are inserted into the slot machine when the player pushes down a ball inserting operator. Further, the number of pachinko balls having an economical value corresponding to one medal is referred to as "exchange rate" in this specification. However, this means that the economical values are of equal value; it does not mean whether the medal and the pachinko balls are actually exchangeable.

The inserted pachinko balls are counted by a pachinko ball detecting section and then collected in a ball collecting tank. The collected balls are then sent up to a top plate by a lift-send apparatus.

This kind of game machine is disclosed in, for example, Japanese Patent Application Publication (KOKAI) 3-68382.

However, the number of pachinko balls inserted at once is fixed and cannot be changed in this kind of slot machine. Thus, when the exchange rate of one medal and one pachinko ball is changed, the ball inserting operator and other related mechanisms accordingly have to be changed extensively, giving the problem of a rise in cost.

In this kind of slot machine and the like which uses pachinko balls as game media, a pachinko ball dispensing machine (i.e. a ball counter) is a must. This kind of pachinko ball dispensing machine (structure) is shown in FIG. 21.

The pachinko balls are conveyed through the pipe-like ball guide 9. On the way through said ball guide 9, a sprocket 4' is rotatably set in a position so as to partly project into a ball path 90. Around the sprocket 4', concave portions 40 are formed with which pachinko balls can engage, one by one. As the pachinko balls flow through the ball path 90, they come into engagement with the concave portions 40 sequentially and rotate the sprocket 4'.

The rotational angle of the sprocket 4' is controlled by operating a stopper 106 onto a ratchet 5' fixedly connected to the sprocket 4' and having the same axis as the sprocket 4'.

However, this kind of structure has the following problems.

There are a lot of technical difficulties in previously constructing the sprocket 4' and the ratchet 5' as one body such as in FIG. 22, and there is a problem that the manufacturing cost becomes expensive.

On the other hand, when the separately constructed sprocket 4' and ratchet 5' are connected as one, and then fixed to a frame body 101, a complicated fixing operation is needed taking a lot of time. For example, one manufactured body such as the sprocket 4' assembly possibly interferes with other members, such as the stopper 106, making the operation troublesome.

SUMMARY OF THE INVENTION

The first object of the present invention is to provide a slot machine which can be adapted, easily and at low cost, to changes in the exchange rate of the pachinko balls to the medal.

The second object of the present invention is to provide a pachinko ball dispensing apparatus in which the manufacturing process is easy and the manufacturing cost is reduced.

The present invention is made to achieve the above objects, and a first embodiment provides a slot machine characterized in that it comprises:

a selecting means which specifies a gambling number which has a certain corresponding relationship with the number of game media used for the game;

a storing means provided with a predetermined unit number;

a game portion which conducts the game by using the number of pachinko balls calculated using said unit number and the gambling number selected by using said selecting means;

a dispensing means which dispenses the number of pachinko balls calculated using said unit number as a prize, according to the result of said game; and a changing means which changes said unit number.

In this first present embodiment, the unit number can be changed using the changing means. The game portion and the dispensing portion take in the pachinko balls according to the said changed unit number and determine the number of pachinko balls to be dispensed as prizes. Thus, when the ratio of the economical value (i.e. the exchange rate) of one medal and one pachinko ball changes, it is not necessary to dramatically change the construction of the ball inserting operator and other inserting structures and that decreases the cost.

The second embodiment of the present invention provides a pachinko ball dispensing apparatus characterized in that it comprises:

a ball guide which comprises a ball path where the pachinko balls flow;

a sprocket which comprises an axis (from now on referred to as a sprocket axis), being pushed by the pachinko balls flowing through said ball path, and maintained in a condition rotatable about said sprocket axis; and a ratchet wheel which comprises an axis (from now on referred to as a ratchet axis), and composed rotatable about said ratchet axis by linking to said sprocket; and wherein said sprocket axis and said ratchet axis are composed linkably in a condition where both can be freely put on and taken off.

In this case, said sprocket axis comprises a projected fixing portion at the opposite side end portion of said ratchet wheel;

said ratchet axis comprises a fixable concave fixing portion of said projected fixing portion, at the opposite side end portion of said sprocket; and said linkage is done by fixing said projected fixing portion and said concave fixing portion.

BRIEF DESCRIPTION OF THE DRAWINGS

FIG. 18(*b*) is a side view of the sprocket 4.

FIG. 19(*b*) is a side view of the ratchet wheel 5.

DETAILED DESCRIPTION OF THE PREFERRED EMBODIMENT

The first embodiment of the present invention will now be described in detail with reference to the drawings.

A slot machine 1 of the present embodiment uses pachinko balls as game media in place of medals. The present embodiment is characterized by the construction of a portion for dispensing pachinko balls. Therefore, the emphasis is put on describing this characteristic feature, and description of the other parts is omitted.

Figure 1:
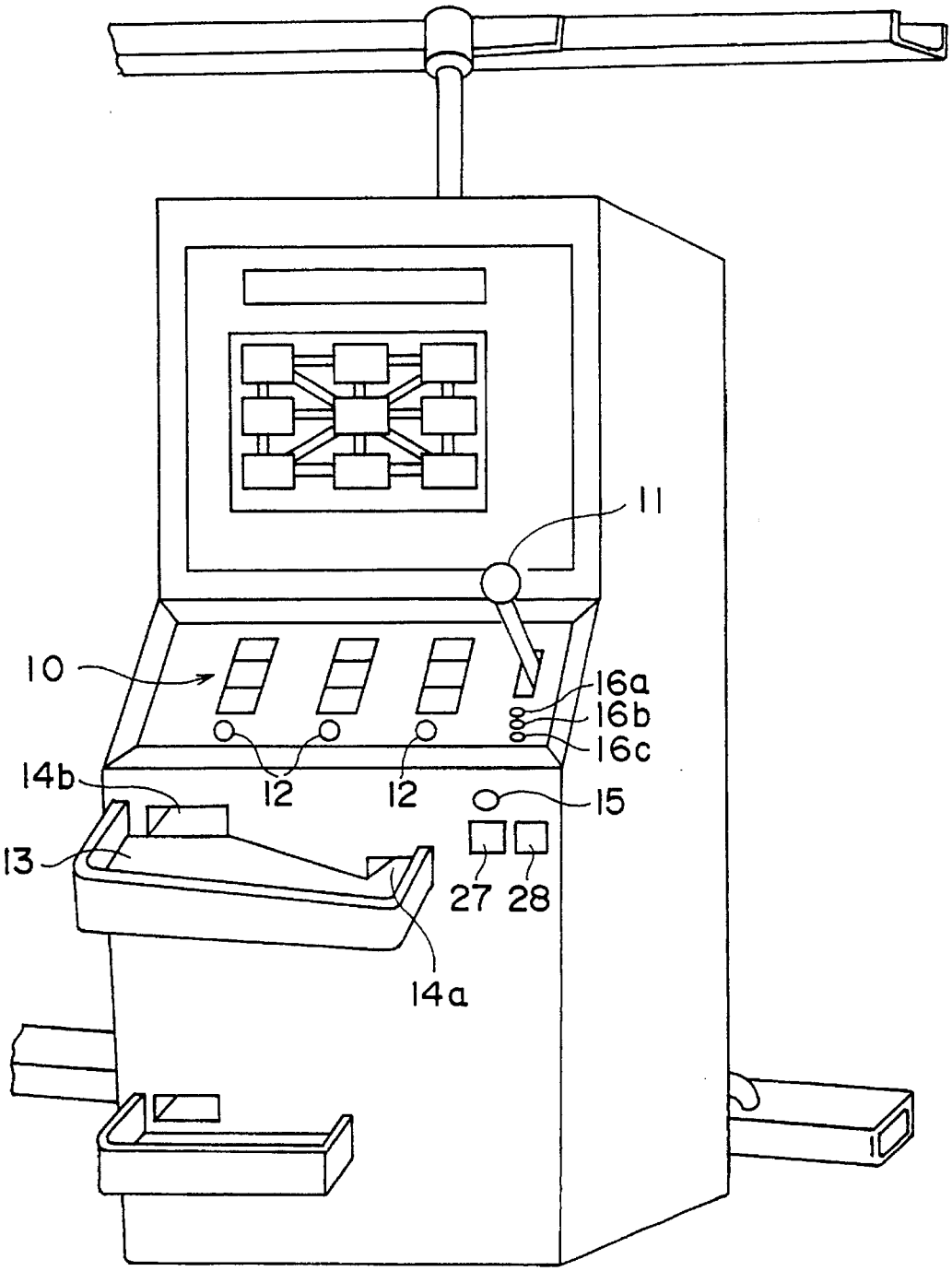
FIG. 1 is a perspective view of a slot machine of an embodiment of the present invention.

As illustrated in FIG. 1, the slot machine 1 of the present embodiment comprises, in its front side, a variable display section 10 for displaying variable patterns, a starting lever 11, an ending button 12, a ball tray 13, a ball inserting port 14*a*, a prize ball dispensing port 14*b*, a ball inserting switch 15, and a selecting switch 16. In its inside and at its back, it is provided with a prize ball tank 17, a dispensing apparatus 18, and a guide pipe 19 as shown in FIG. 2.

The ball inserting switch 15 is for preliminarily inserting pachinko balls before starting the game. By operating the ball inserting switch 15, the player is able to insert the desired number of pachinko balls at one time from among the pachinko balls on the ball tray 13 through the ball inserting port 14*a* into the slot machine. Further, the number of pachinko balls inserted is calculated by an inserted ball counting means as will be described later and displayed on a inserted ball number display 27.

The selecting switch 16*a*, 16*b*, and 16*c* (the three switches will simply be referred to as "the selecting switch 16" hereinafter) are provided for players to specify the number of pachinko balls to be bet for one game from the pachinko balls inserted. In the present embodiment, five pachinko balls are bet for a game by operating the selecting switch 16*a*. Similarly the switch 16*b* corresponds to ten balls and switch 16*c* to fifteen. These numbers 5, 10, and 15 correspond to once, twice, and three times the exchange rate of the pachinko balls, or to single bet, double bet, and triple bet of the medals. However, these numbers of balls are not fixed but are changeable, as will be shown later. The operating condition of the selecting switch 16 is detected by a control/calculating section 20 which will be described later. Moreover, the number displayed on the inserted ball number display section 27 is decreased by the number bet using the selecting switch 16.

Figure 2:
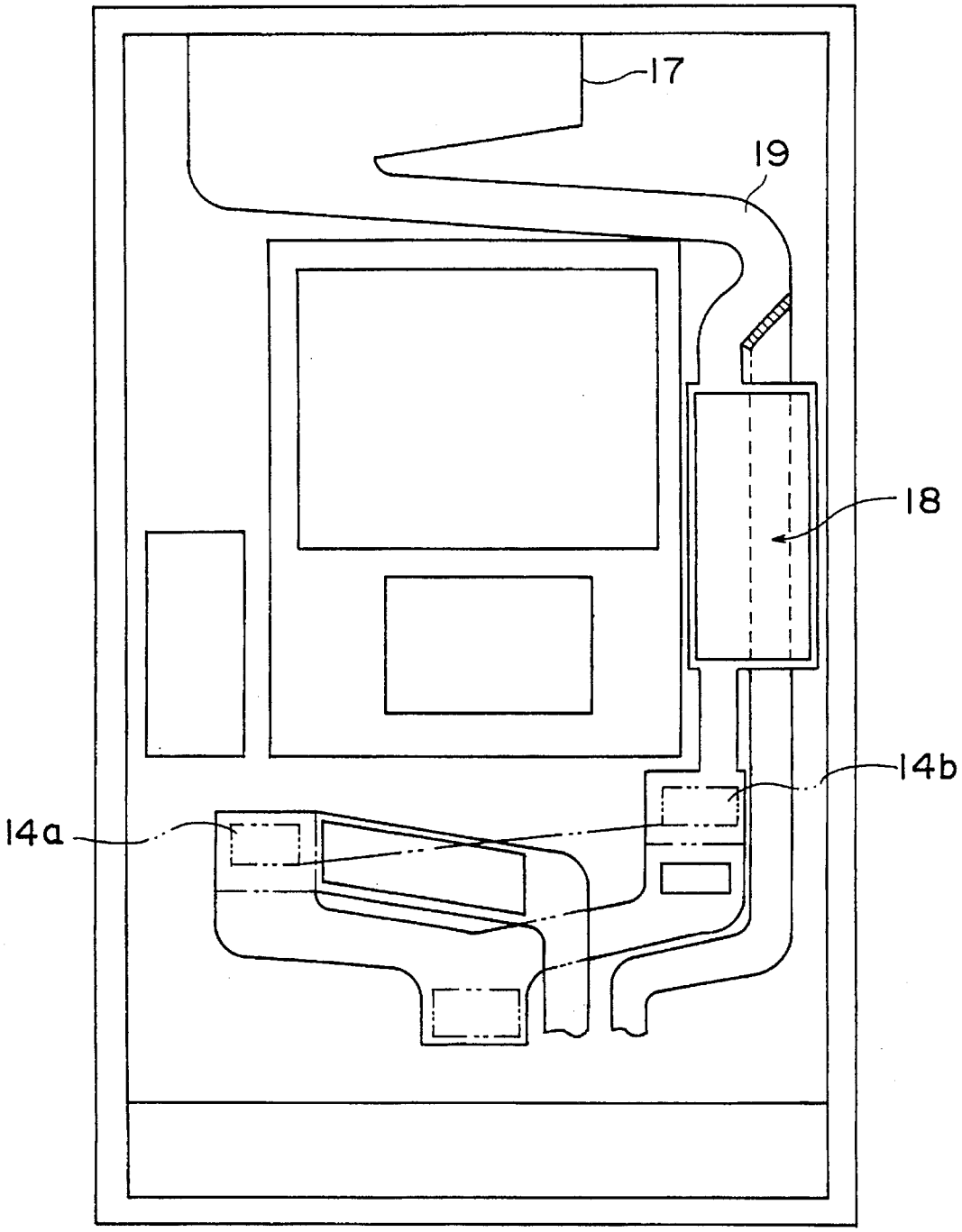
FIG. 2 is a rear view of the slot machine.

As shown in FIG. 2, the prize ball tank 17 is for storing the pachinko balls supplied from outside and is placed at an uppermost portion of the slot machine 1. The pachinko balls supplied to the prize ball tank 17 are dispensed through the dispensing apparatus 18. In this respect, the pachinko bails are supplied to the prize ball tank 17 through a supply channel (not shown) provided along the rear side of an island formed of slot machines 1.

The guide pipe 19 forms a flow path of the pachinko balls between the prize ball tank 17 and the dispensing apparatus 18.

The transference of the pachinko balls within said guide pipe 19 basically is made only by the gravity applied onto the pachinko balls.

The internal construction of the slot machine for effecting control will be described using FIG. 3. The slot machine comprises the control/calculating section 20, a drive circuit 21, an inserted ball detecting sensor 23, a dispensing section 24, a prize ball counting means 25, a change instruction inputting apparatus 26, an inserted ball number display section 27, and a holding ball number display section 28. Also, although not shown in the figures, a mechanism to drive the variable display section is provided. However, since this is not related to the essence of the present invention, the explanation thereof will be omitted.

The ball inserting switch 15 and the selecting switch 16 are described above.

The inserted ball detecting sensor 23 is for detecting the pachinko balls inserted into the slot machine 1 through the ball inserting port 14*a*. The result of the detection is outputted to the control/calculating section 20.

The dispensing section 24 comprises a structural implement for actually dispensing the balls. Further, the prize ball counting means 25 is for counting the number of prize balls actually dispensed by the dispensing section 24. The number of dispensed prize balls are previously determined, according to the pattern of the variable display section 10. The structure of said dispensing section 24 and the prize ball counting means 25 are realized by the dispensing apparatus 18 shown in FIG. 2. Furthermore, the dispensing apparatus 18 will later be described in detail.

Figure 4:
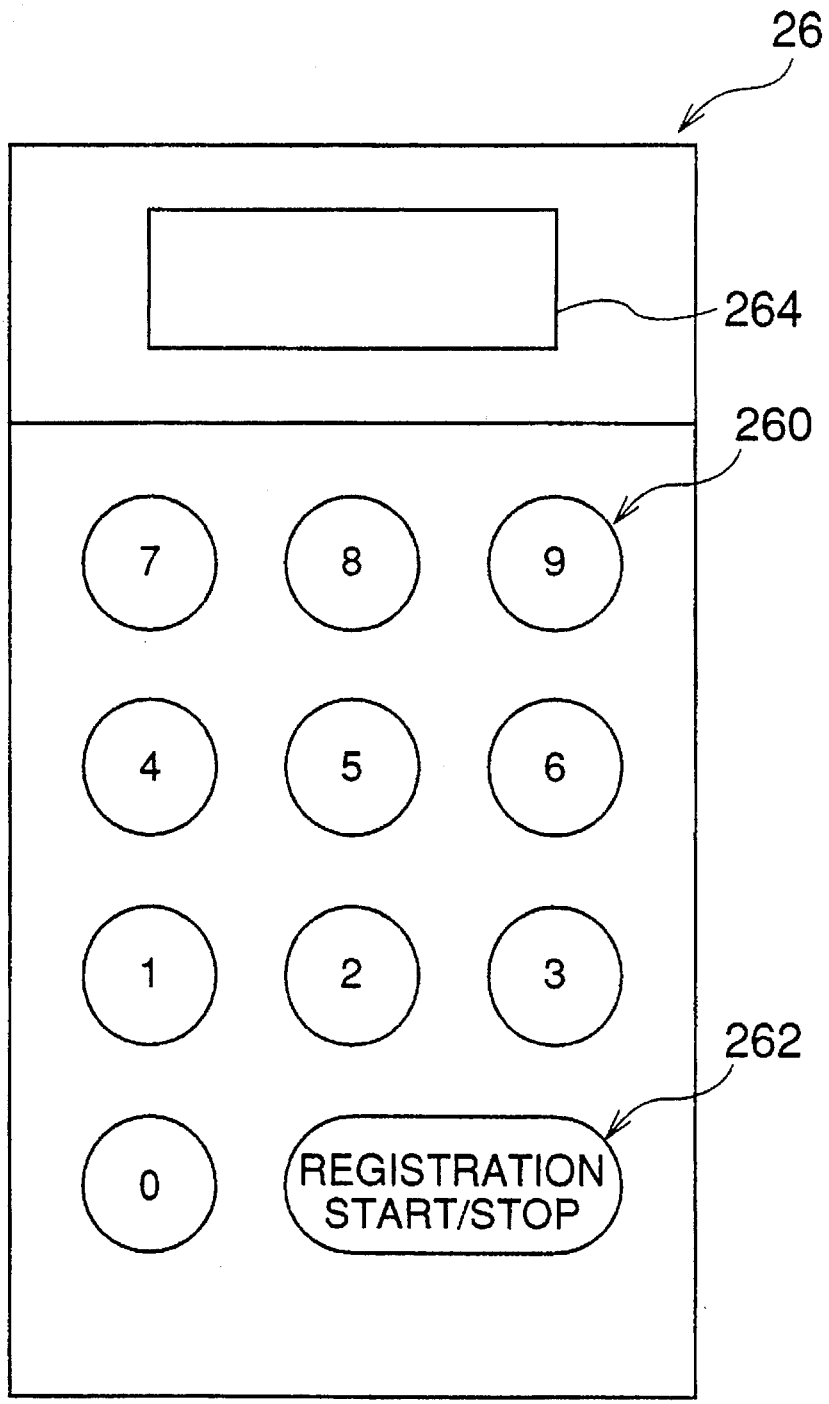
FIG. 4 is a front view of a change instruction inputting apparatus 26.

The change instruction inputting apparatus 26 is for changing the unit number of the pachinko balls in the game. The number of pachinko bails handled in the game is the integral multiplication of a certain number (unit number) determined according to the exchange rate of the pachinko balls to the medals. When the exchange rate changes, the unit number needs to be changed. A manager of the slot machines may input a change instruction of the unit number by operating the change instruction inputting apparatus 26. The change instruction inputting apparatus 26 is used only when the exchange rate is changed; it is not used normally. The change instruction inputting apparatus 26 of the present embodiment is shown in FIG. 4. The change instruction inputting apparatus 26 comprises a ten-key pad 260, a registration key 262, and a liquid crystal display 264. The registration key 262 is for inputting the starting and ending of the change instruction input. The ten-key pad 260 is for inputting a value indicative of a new exchange rate. Moreover, the liquid crystal display 264 is so constructed that an operation guide for the manager as well as the numeral value inputted from the ten-key pad 260 may be displayed. The control of the change instruction inputting apparatus 26 is done by the control/calculating section 20. Further, the specific structure of the change instruction inputting apparatus 26 is not limited to this; a DIP switch, for example, can be used for structure.

The control/calculating section 20 is for controlling the entire operation of the slot machine. The control/calculating section 20 comprises electronic circuits including a micro computer 200, a memory 202, a memory 204 etc., as well as programs and data stored in these. For example, the control/calculating section 20 outputs the operation directions of the dispensing section 24 etc. to the drive circuit 21 according to the detection result of the detecting means 83 etc. Further, a function for changing rate values, according to the input from the change instruction inputting apparatus 26, is provided as will be shown later.

Figure 5:
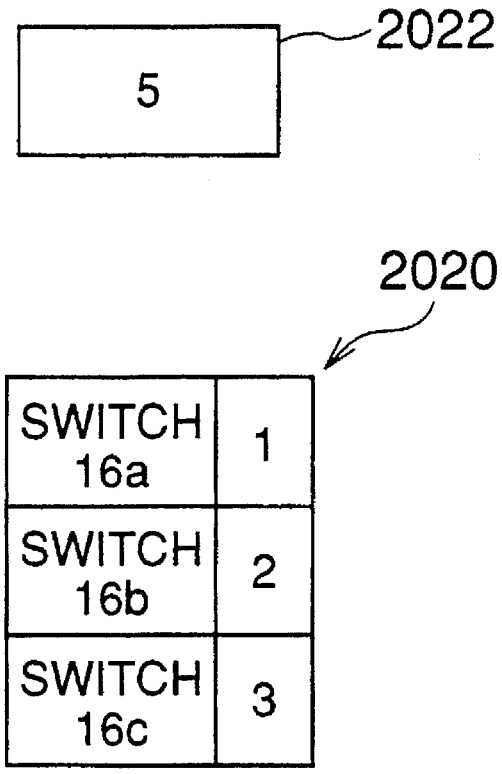
FIG. 5 shows one example of data to be stored within a memory 202.

The memory 202 is a non-volatile or fixed semiconductor memory able to be rewritten electrically. In the memory 202, a bet number 2020 and a rate value 2022 are stored, other than the programs which regulate a controlling operation (refer to FIG. 5). The "bet number" corresponds to the number of medals bet in an ordinary slot machine, and is determined for each kind of the inserted ball selecting switches 16. In the present embodiment, the bet number of the inserted ball selecting switches is determined as follows: 16*a* to 1, 16*b* to 2, and 16*c* to 3. The "rate value" is a value which shows the number of pachinko balls equivalent or corresponding to one medal (i.e. exchange rate). These are the data used in determining the number of pachinko balls which are taken in/dispensed. The numbers 5, 10, and 15 as mentioned before are the values obtained respectively by multiplying these data. Rewriting the contents of the memory 202 is done by the control/calculating section 20.

Figure 6:
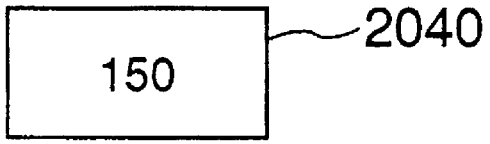
FIG. 6 shows one example of data to be storm within a memory 204.

The memory 204 includes a DRAM. The memory 204 is for storing the number of pachinko balls (from now on referred to as "inserted ball number 2040") which were inserted through the ball inserting port 14*a* but have not been used in the game (refer to FIG. 6). The inserted ball number 2040 is renewed when pachinko balls are newly inserted or when a new game starts. Furthermore, the memory 204 is constructed in such a way that the numeral value inserted from the change instruction inputting apparatus 26 is stored temporarily when renewing the rate value.

The drive circuit 21 is a circuit for actually controlling the dispensing section 24. The drive circuit 21 is for actually applying an exciting voltage to each of a main solenoid and a sub-solenoid 60, which will be described later, according to the instructions from the control/calculating section 20. The details of the drive circuit 21 will be explained later using FIG. 14.

The inserted ball number display section 27 is for displaying the number of pachinko balls inserted through the ball inserting port 14*a* but have not been used in the game.

The holding ball number display section 28 is for displaying the number of prize balls which have not been dispensed.

This concludes the outline explanation of the slot machine. Each of the sections as mentioned above will now be explained in detail.

The structure for inserting pachinko balls from the ball inserting port 14*a* is first explained.

Figure 7:
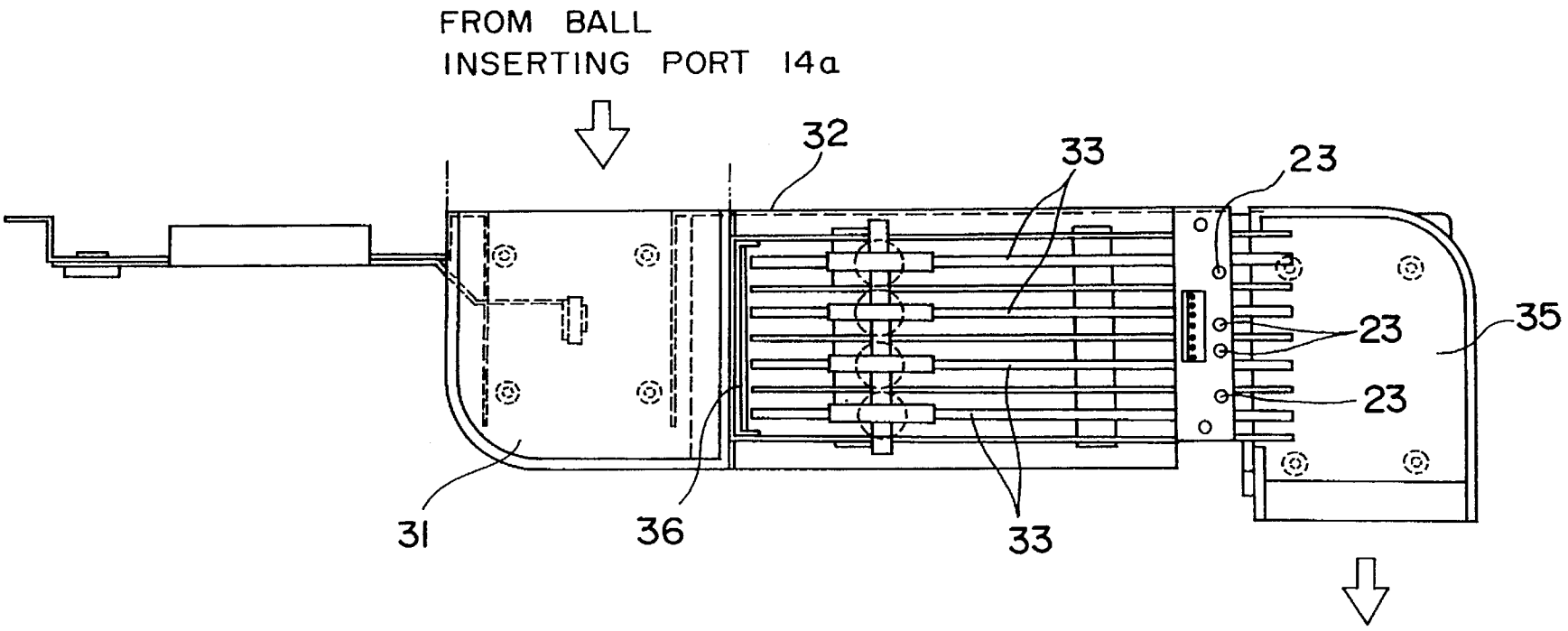
FIG. 7 shows a ball inserting port 14 a together with related portions.

The inserted ball detecting sensor 23 is provided at the inner side of the ball inserting port 14*a* of the ball tray 13 (within the slot machine). At the inner side of the ball inserting port 14*a*, as shown in FIG. 7, a take-in stage 31, an introduction path 32 whose starting end is connected to the take-in stage 31, line up rails 33 which are set in parallel in four lines in the introduction path 32, and a dispensing stage 35 connected to the terminating end of the introduction path 32 are provided. The inserted ball detecting sensors 23 are provided at the terminating end of each line up rail 33.

Further, a shutter member 36 is provided between an exit of the take-in stage 31 and the starting end of the introduction path 32. The shutter member 36 is for controlling the flow of the pachinko balls within the take-in stage 31 to the introduction path 32. The shutter member 36 is driven by a rotary solenoid not shown in the drawings, and is constructed in such a way that it is able to open and shut. When the shutter member 36 is shut, the pachinko balls within the take-in stage 31 cannot flow into the introduction path 32. On the other hand, when the shutter member is opened, the pachinko balls can flow into the introduction path 32.

Next, the dispensing apparatus 18 which constitutes the dispensing section 24 and the prize ball counting means 25 will be explained in detail using FIG. 8 and FIG. 13.

The dispensing apparatus 18 is constructed by a sprocket 4, a ratchet wheel 5, a main stopper 61, a sub stopper 71, the main solenoid 60, the sub solenoid 70, a ball guide 9, and detecting means 81, 82, and 83. These are encased within a main body frame 180 which comprises a supporting frame and a surface cover.

The supporting frame is made of a metal sheet and formed in a shape of a box. The surface cover covers an opening of the supporting frame. The surface cover is made of transparent resin so that the sprocket 4 within the apparatus can be seen from the outside. However, gradation processing and masking processing may be partly done.

The ball guide 9 is a transparent pipe having an inner diameter a little larger than the diameter of a pachinko ball; it is set in such a way that it extends at one side of the frame body 180 from top to bottom. An upper end of an opening of the ball guide 9 is communicated to the guide pipe 19. From now on, the path for the pachinko balls formed inside the ball guide 9 wild be called a "ball path 90". The ball guide 9 has, at the position within the frame body 180, an elongated slot extending in its axial direction. The pachinko balls flowing inside can be seen from the outside because the ball guide 9 is made of a transparent material.

At the periphery of the sprocket 4, ten concave portions 40 where the pachinko balls can engage one by one are formed; at the center, an input shaft 41 is provided. The input shaft 41 of the sprocket 4 is supported at the position where the tips of the cogs (the jutted out portion between one concave portion 40 and another adjacent concave portion 40) reach the ball path 90 through the slot of the ball guide 9. The sprocket 4 is rotatably supported by the input shaft 41. As a result of this, the sprocket 4 is rotated by the tips of the cogs when pushed by the pachinko bails flowing through the ball path 9.

Further, at the position opposite to the sprocket 4, a slanted section 93 protruding inside is provided on an inside wall surface 92 of the ball guide 9. Where the slanted section 93 exists, the pachinko balls take a passage nearer to the sprocket 4 within the ball path 90 and fit precisely into the concave portions 40. In other words, the sprocket 4 will definitely rotate together with the flow of the pachinko balls.

The ratchet wheel 5 is connected to the sprocket 4 so that both of them have the same axis. Thus, the ratchet wheel 5 and the sprocket 4 are composed to rotate as one. The ratchet wheel 5 does not interfere with the ball guide 9. The connecting structure of said sprocket 4 and the ratchet wheel 5 is a characteristic feature of the present invention. This point will be explained later.

The ratchet wheel 5 has the same number of cogs 50 as the sprocket 4 at its periphery. Further, small holes 53 for passing detecting light for the detecting means 81 are provided corresponding to each of the cogs 50. The phase relationship of the ratchet wheel 5 and the sprocket 4 is such that when the main stopper 61 is engaged with the ratchet wheel 5, the tip ends (the jutted out portion between concave portions 40) of the sprocket 4 are positioned on corresponding left and right cogs 50.

The rotation of the sprocket 4 and the ratchet 5 is controlled by a governor 55. The governor 55 is swingably mounted at its base end portion 551 to a governor axis 550. From the base end portion 551, engaging pieces 552*a*, 552*b* which are engageable with the concave portions 40 of the sprocket 4 extend to left and right (upwardly and downwardly in FIG. 8). At a top surface of the base end portion 551, a disc-form weight 56 having a large inertia is provided. The governor 55 swings about a governor axis 550 with the rotation of the sprocket 4; the engaging piece 552*a* and the engaging piece 552*b* engage with the periphery of the sprocket 4 alternately. Therefore, as one pachinko ball passes, the sprocket 4 rotates by an angle of one concave portion 40.

The main stopper 61 and the sub stopper 71 are for controlling the rotation of the ratchet wheel 5.

The main stopper 61 is swingably mounted on a stopper axis 62 which is parallel to the shaft 41 of the sprocket 4. The main stopper 61 engages at its tip 610 with the ratchet wheel 5 at the position after turning counterclockwise. The turning is done by the forces from the main solenoid 60 and a spring 63 which will be described later.

The main solenoid 60 has its output axis 600 connected to the base end portion of the main stopper 61. When the main solenoid 60 is excited, it works towards the direction where the output axis 600 retractor (the upper direction in FIG. 8), and turns the main stopper 61 clockwise (this condition is shown by broken lines in FIG. 12).

The spring 63 wound around the stopper axis 62 activates the main stopper 61 in a counterclockwise direction (i.e. in the direction to engage with the ratchet wheel 5). When the main solenoid 60 is not driven, the main stopper 61 is restored to the position to engage with the ratchet wheel 5 by the urging force of the spring 63.

The main solenoid 60 and the spring 63 constitute the main drive means in the present invention.

The sub stopper 71 is fixed to a stopper axis 62 in a condition free to turn. In a position turned clockwise, a tip portion 710 engages with the periphery of the ratchet wheel 5. The base end portion of the sub stopper 71 is pressed against a bottom of the main stopper 61 by the urging force of a spring 72 wound around the stopper axis 62. Thus, as long as a force not exceeding the urging force of the spring 72 is operative, the sub stopper 71 is linked (as one body) to the main stopper 61 and turned together in the same direction. When an outer force exceeding the urging force given by the spring 72 occurs, the coupling with the main stopper 61 is released, and the sub stopper 71 turns individually from the main stopper 61.

In the condition where the sub stopper 71 and the main stopper 61 are linked to conjointly move, both stoppers 71 and 61 alternately engage with the ratchet wheel 5. When turned clockwise, the coupling of the main stopper 61 with the ratchet wheel 5 is released, and on the other hand, the tip portion 710 of the sub stopper 71 engages with the left top portion of the ratchet wheel 5. Alternately, when turned counterclockwise, the coupling of the sub stopper 71 with the ratchet wheel 5 is released, and this time, the tip portion of the main stopper 610 engages with the lower portion of the ratchet wheel 5. In this connection, it is to be noted the accurate timing of the movement is such that the sprocket 4 and the ratchet wheel 5 are allowed to turn by an angle corresponding to half of the concave portion 40 after the engagement with the main stopper 61 is released and before the engagement with the sub stopper is completed.

The sub solenoid 70 and a lever 73 are for turning the sub stopper 71 independently from the main stopper 61 to release the connection with the ratchet wheel 5.

Figure 13:
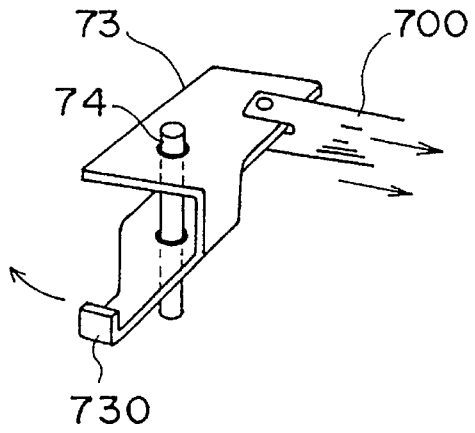
FIG. 13 is an enlarged perspective view showing the fixing condition of a lever 73.

The lever 73, as shown in FIG. 13, is rotatably supported about a lever axis 74; a click 730 provided on its one side is engaged with an elongated hole 711 provided on the sub stopper 71. Therefore, the sub stopper 71 can be turned in a desired direction by turning the lever 73. When the lever 73 is turned clockwise, the sub stopper 71 is turned counterclockwise. The turning of the lever 73 is done by the sub solenoid 70 and the spring 72.

The sub solenoid 70 has its output axis 700 connected to an end portion opposite to the click 730 of the lever 73. When the output axis 700 is operated in the direction in which the output axis 700 retracts (the right direction in FIG. 8), the lever 73 turns clockwise (this condition is shown by broken lines in FIG. 12). Thus, the connection to the ratchet wheel 5 can be released by turning the sub stopper 71 counterclockwise, irrespective of the position of the main stopper 61 at that moment.

The spring 75 urges the lever 73 counterclockwise. Therefore, when the drive of the sub solenoid 70 is released, the lever 73, returns by this urging force to the position not letting The sub stopper 71 turn.

The sub solenoid 70 and the lever 73 constitute the sub driving means of the present invention.

Figure 3:
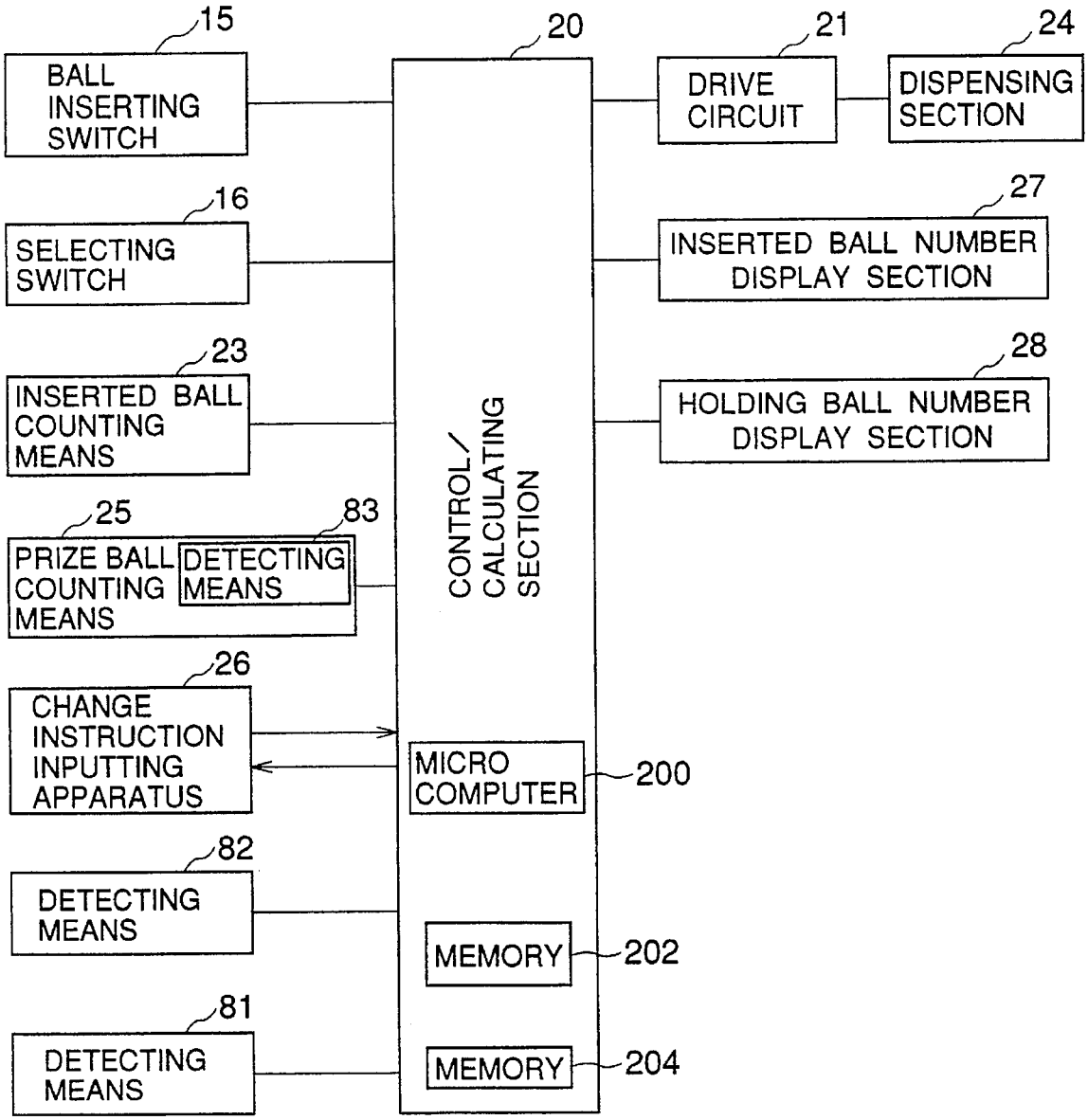
FIG. 3 is a block diagram showing the controlling arrangement.

The detecting means 81 is for detecting the rotation of one concave portion 40 of the sprocket 4, as shown in FIG. 3. In the present embodiment, the detecting means 81 is constructed including a photo-electric switch. The detecting means 81 detects the rotating condition of the ratchet wheel 5 (or the sprocket 4) by emitting detecting light at the position where the small holes 53 of the ratchet wheel 5 pass and detecting the light. The concrete construction of the detecting means 81 is not limited to this.

The detecting means 82 is for detecting the supply condition of the pachinko balls. In the present embodiment, the detecting means 82 is constructed including a photo-electric switch. The detecting means 82 detects the supply condition of the pachinko balls by emitting detecting light at the position just after a pachinko ball is engaged with a concave portion 40 of the sprocket 4 and detecting that light. The detecting means 82 outputs a signal to the control/calculating section 20 every time it detects a ball. The interruption of the output signal indicates there is an interruption in the supply of the pachinko balls in the ball path 90.

The detecting means 83 is for detecting the dispensing of the pachinko balls. In the present embodiment, the detecting means 83 is constructed including a luminescent section for emitting detecting light at the position where a pachinko ball is just released from the concave portion 40, and a light receiving section for receiving the light. The luminescent section and the light receiving section are provided on the inside wall surface 92 of the ball guide 9 at positions opposite to each other, sandwiching the ball path 90. The detecting means 83 outputs a signal to the control/calculating section 20 every time it detects a pachinko ball is dispensed. It is reliable to detect the dispensing by using the detecting means 83, but it is also possible to indirectly detect the dispensed number by the detecting means 81.

Moreover, the detecting means 81 and 82 are constructed similarly, including a luminescent section and a light receiving section. In the present embodiment, these are constructed including a light sensor, but they can be constructed by a sensor which has a contact operable due to the change in the magnetic field caused by the falling of the pachinko balls.

Figure 14:
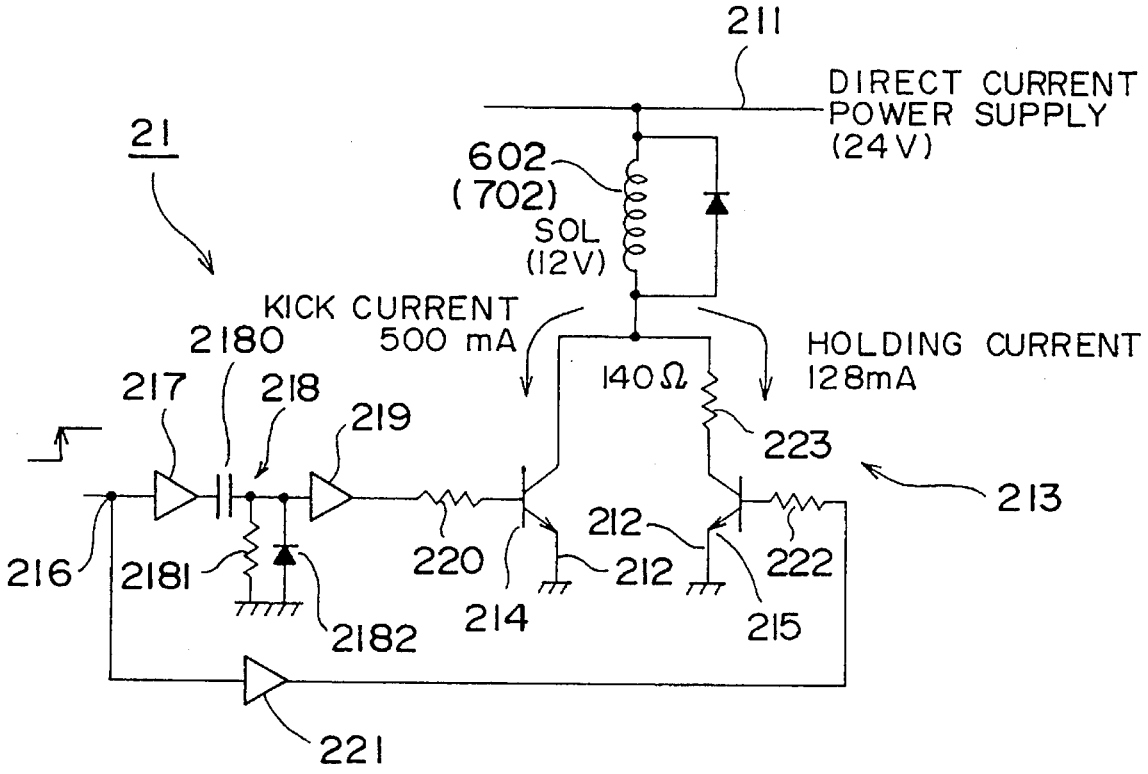
FIG. 14 is a circuit diagram including a drive circuit 21.

The drive circuit 21 will now be explained in detail using FIG. 14.

The drive circuit 21 is constructed such that a coil 602 of the main solenoid 60 and a switching circuit 213 are connected in series between a direct current power supply 211 and a ground 212.

The switching circuit 213 is provided with two NPN transistor 214 and 215 connected in parallel. Between the base electrode of the transistor 214 and an input terminal 216, a buffer 217, a differentiating circuit 218, a buffer 219, and a resistance 220 are provided. On the other hand, between the base electrode of the transistor 215 and the input terminal 216, a buffer 221 and a resistance 222 are provided. Further, between the coil 602 and a collector electrode of the transistor 215, a resistance 223 is provided.

The input terminal 216 is a terminal where the drive instruction (ON signal) of the main solenoid 60 is inputted from the control/calculating section 20. The actual drive instruction is shown as the rise of the electric potential.

The differentiating circuit 218 is constructed from a capacitor 2180, a resistance 2181, and a clipping diode 2182, and is well known. The differentiating circuit 218 outputs ON after a fixed time has passed from the point where the input terminal 216 became ON. Furthermore, this fixed time is determined according the time constant of the differentiating circuit 218. In the present embodiment, said fixed time is made somewhat longer than the time needed for the output axis 600 of the main solenoid 60 to move from the yet-to-start position (where the output axis 600 is at the lowest position in FIG. 8) to the starting position (where the output axis 600 is at the highest position in FIG. 8).

The impressed voltage to the coil 602 after said fixed time has passed is set to become a holding voltage by the resistance 223. In this case, for example, if the supply voltage of the direct current power supply 211 is 24 V, the resistance of the main solenoid 60 is 48Ω, the rated voltage is 12 V (the rated current is 250 mA), and the holding voltage is 6.1 V (the holding current is 128 mA), then the resistance 223 may be 140Ω.

Only the circuit concerning the main solenoid 60 is described here, but a similar circuit is separately provided for the coil 702 of the sub solenoid 70. Thus, the sub solenoid 70 and the main solenoid 60 can be controlled individually.

In the present embodiment, the "selecting means" in the claims of the patent is constructed to include a selecting switch 16. The "storing means" is constructed to include the memory 202. The "game section" is constructed to include the change display section 10, the control/calculating section 20. etc. The "dispensing means" is constructed to include a dispensing apparatus 18. The "changing means" is constructed to include the change instruction inputting apparatus 26.

The summary of the take in operation of the pachinko balls in the present embodiment will be explained next.

The pachinko balls put into the ball tray 13 go on top of the take-in stage 31 of the inserted ball counting means 23 provided at the inner side of the ball tray 13, and are held there by the shutter member 36 (refer to FIG. 7).

When the player turns the ball inserting switch 15 to ON, to start the game, the control/calculating section 20 operates the rotary solenoid not shown in the figures to open the shutter member 36. Then, the pachinko balls held until then will flow along (roll on) the line up rails 33. The inserted ball detecting sensor 23 detects the pachinko balls inserted in this way and outputs to the control/calculating section 20. After adding to this the number of the pachinko balls that have been inserted but not yet used in the game (this is stored in the memory 204 as the inserted ball number 2040), the control/calculating section 20 digitally displays this calculated result on the inserted ball number display section 27. Together with this, the contents of the memory 204 are renewed. The inserted pachinko balls will then flow into the channel for collecting via the stage 35 and a dumper for deceleration.

After inserting a desired number of pachinko balls into the slot machine, the player turns the ball inserting switch 15 to OFF. Then, the control/calculating section 20 closes the shutter member 36 and stops the take in of the balls from the take-in stage 31.

When the player operates either one of the selecting switches 16*a*, 16*b*, and 16*c*, the control/calculating section 20 reads the rate value 2022 and the gambling number 2020 for the switches from the memory 202 and multiplies them (the value gained by the multiplication is referred to as "taken-in number" from now on). Then, the value to be displayed on the inserted ball number display section 27 and the value of the inserted ball number 2040 are changed to the values where the taken-in number is subtracted. For example, when the selecting switch 16*b* is pressed, the take in number is 10, and the value displayed on the inserted ball number display section 27 will be less by 10. Further, the value of the inserted ball number 2040 will also be less by 10.

When a starting lever 11 is operated in this condition, the control/calculating section 20 starts the changing patterns of the variable display section 10.

After the changing has stopped, the control/calculating section 20 determines the number of the prize balls and outputs the dispensing instructions to the dispensing section 24 etc. The control/calculating section 20 uses the rate value in determining the number of said prize balls. During dispensing, the output signal of the prize ball counting means 25 is observed to check that there is no over dispensing.

Figure 15:
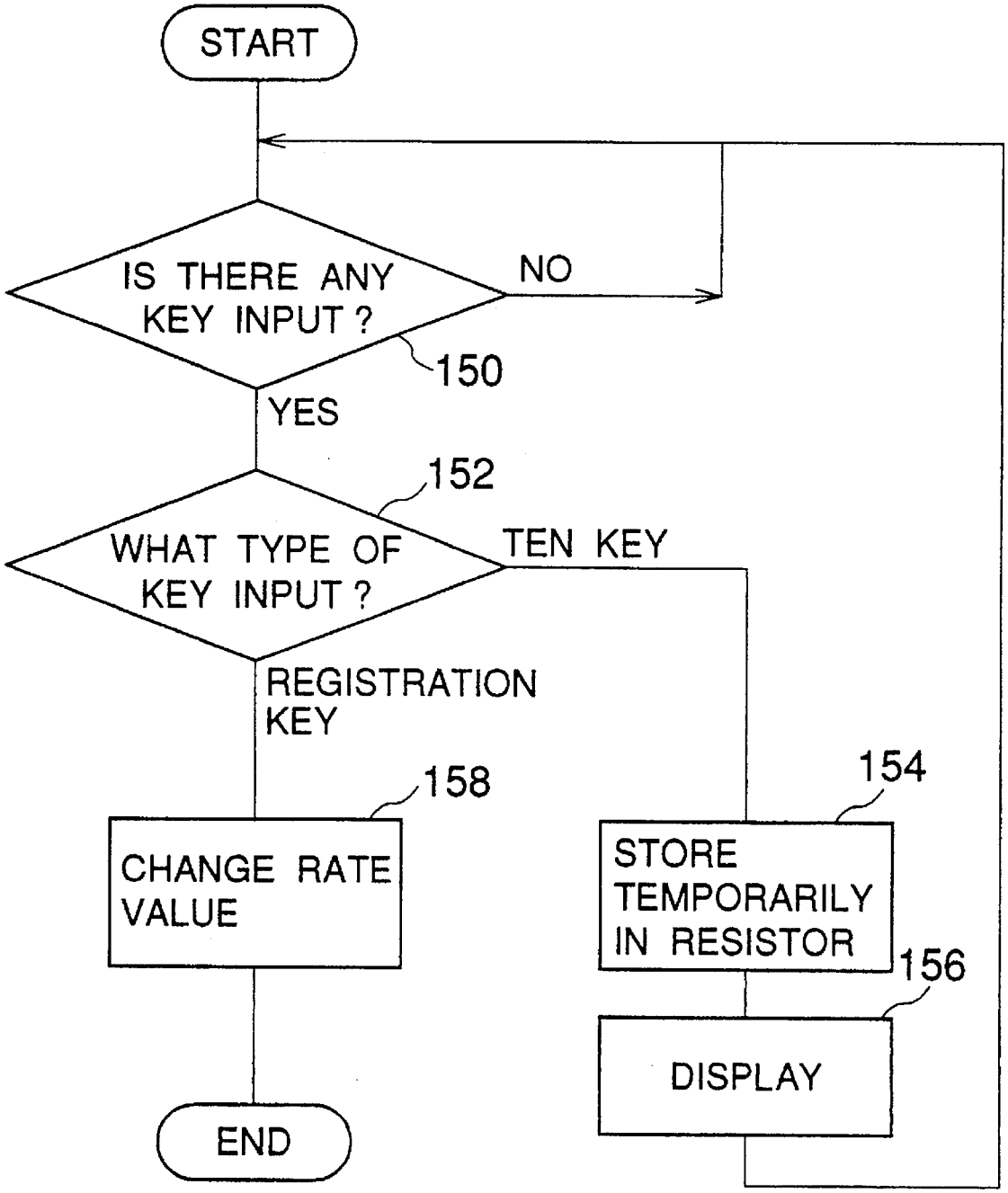
FIG. 15 is a flow chart showing the operation of a control/calculating section 20 during rate value change processing.

Next, the change processing for the rate value will be explained using FIG. 15.

When the manager presses the registration key 262 of the change instruction inputting apparatus 26, the control/calculating section 20 starts the processing shown below.

The control/calculating section 20 will be in a stand-by condition waiting for the input from the change instruction inputting apparatus 26 (step 150). When there is a key input, the type of the key input is distinguished (step 152). When there is an input by the operation of the tenkey pad 260, the inputted numeral value is stored in the memory 204 temporarily (step 154), and the numeral value is displayed on the liquid crystal display 264 (step 156).

On the other hand, if the input is done by the operation of the registration key 262, the control/calculating section 20 formally stores the value temporarily stored in the memory 204 to memory 202 as the rate value 2022 (step 158) and ends the processing.

Next, the dispensing operation of the prize balls by the control/calculating section 20 and the dispensing apparatus 18 (the dispensing section 24, the prize ball counting means 25, etc) will be explained in detail using the flow chart of the FIG. 16.

Figure 8:
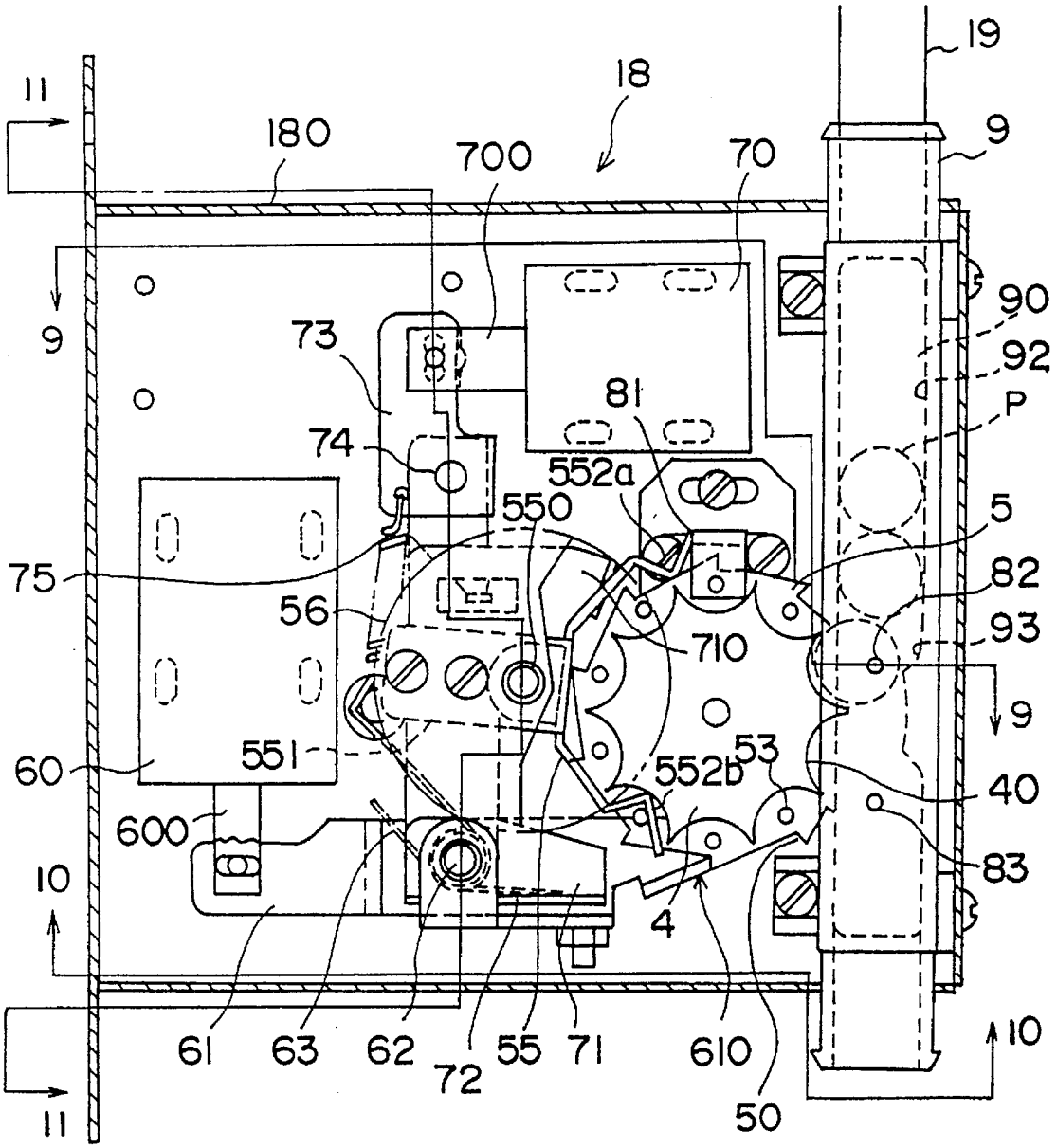
FIG. 8 is a view showing the construction of a dispensing apparatus 18.
Figure 9:
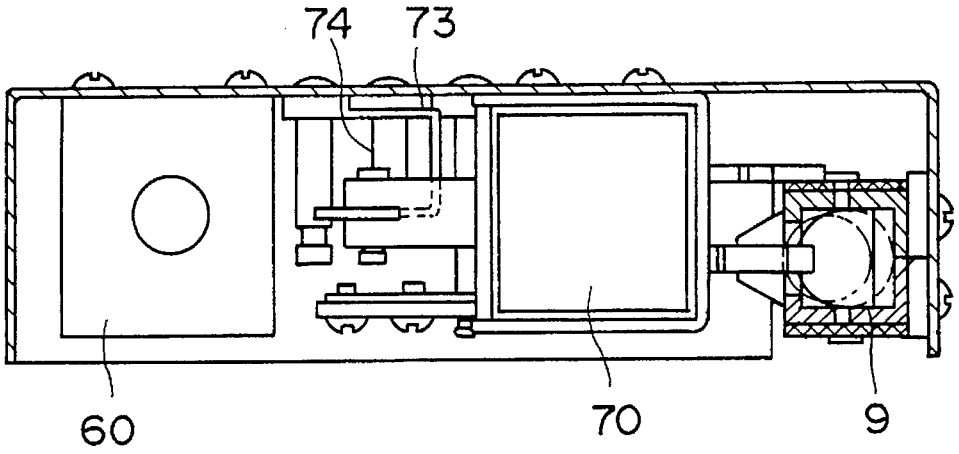
FIG. 9 is a cross sectional view taken along line A—A of FIG. 8.
Figure 10:
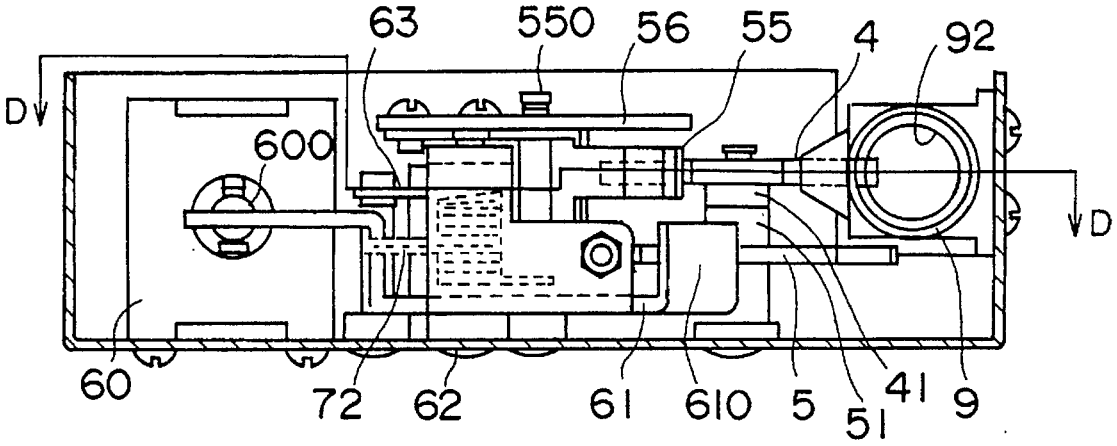
FIG. 10 is a cross sectional view taken along line B—B of FIG. 8.
Figure 11:
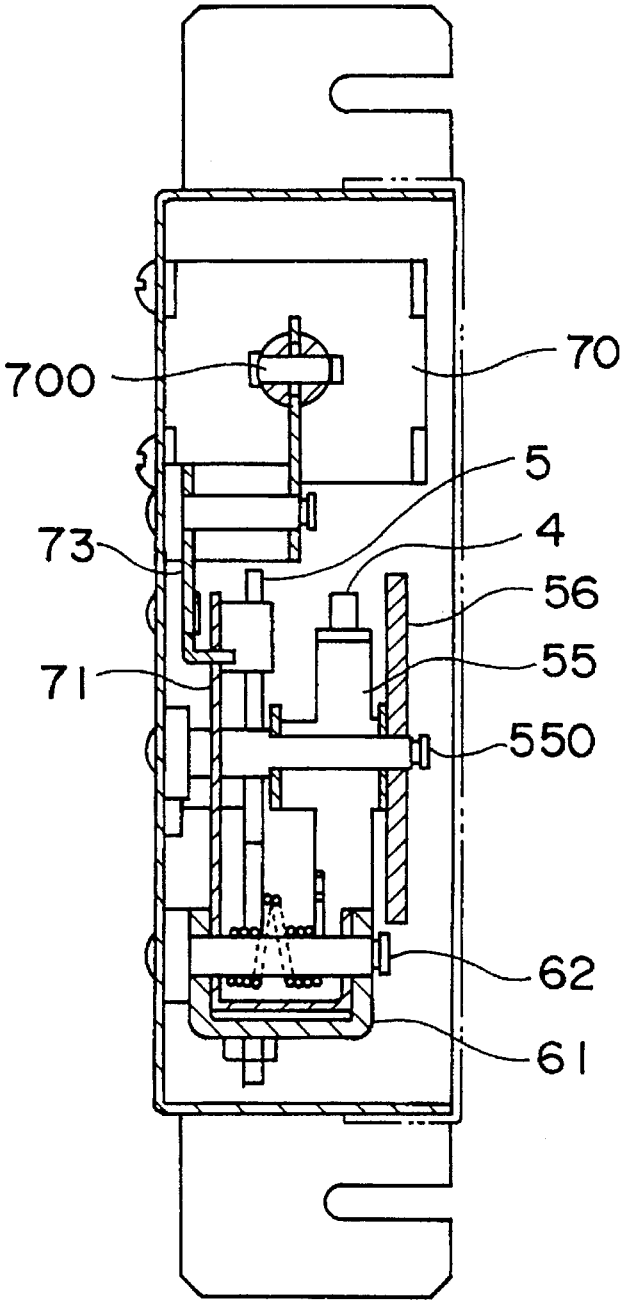
FIG. 11 is a cross sectional view taken along line C—C of FIG. 8.

In the inoperative state where the main solenoid 60 and the sub solenoid 70 are not driven, the main stopper 61 is in a condition engaged with the ratchet wheel 5 by the urging force of the spring 63 as shown in FIG. 8. Thus, the sprocket 4 is maintained in an inoperative state and the pachinko balls will not be discharged.

When dispensing prize balls, the control/calculating section 20 outputs the instruction which starts the main solenoid 60 and the sub solenoid 70 to the drive circuit 21 (step 201).

Figure 17:
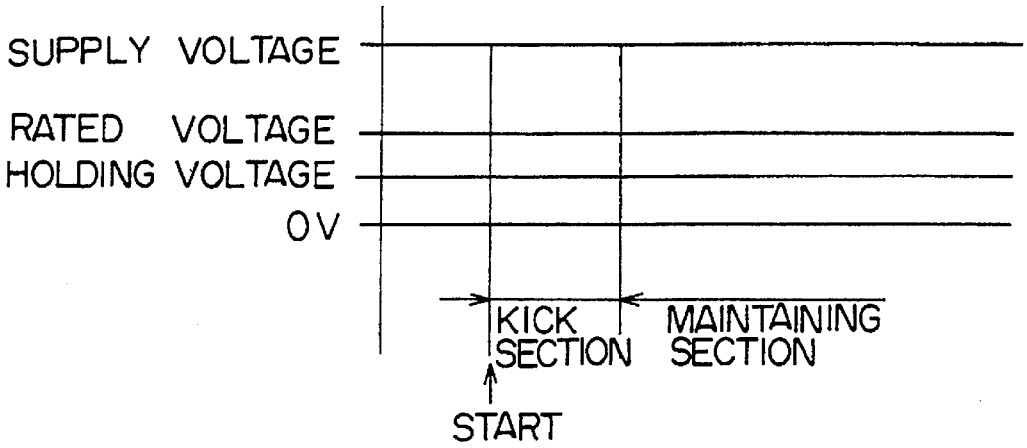
FIG. 17 is a timing chart showing the timing of the operation of the control/calculating section 20 during dispensing of prize balls.

As mentioned earlier, the instruction is given by letting the electric potential of the input terminal 216 rise. Then, as shown in FIG. 17, both the transistor 214 and 215 of the drive circuit 21 at the fixed time (kick section) mentioned earlier will become ON, and the supply voltage 24 V will directly be impressed onto the coil 602 of the main solenoid 60 and the coil 702 of the sub solenoid. A large current (500 mA at the above condition) will flow mainly via the transistor 214. After passing the kick section (maintaining section), the control/calculating section 20 causes only the transistor 214 to be OFF. In this condition, a small current (128 mA at the above condition) will flow through each coil 602 and 702 via the transistor 215, and the impressed voltage will become-the holding voltage of 6.1 V.

Figure 12:
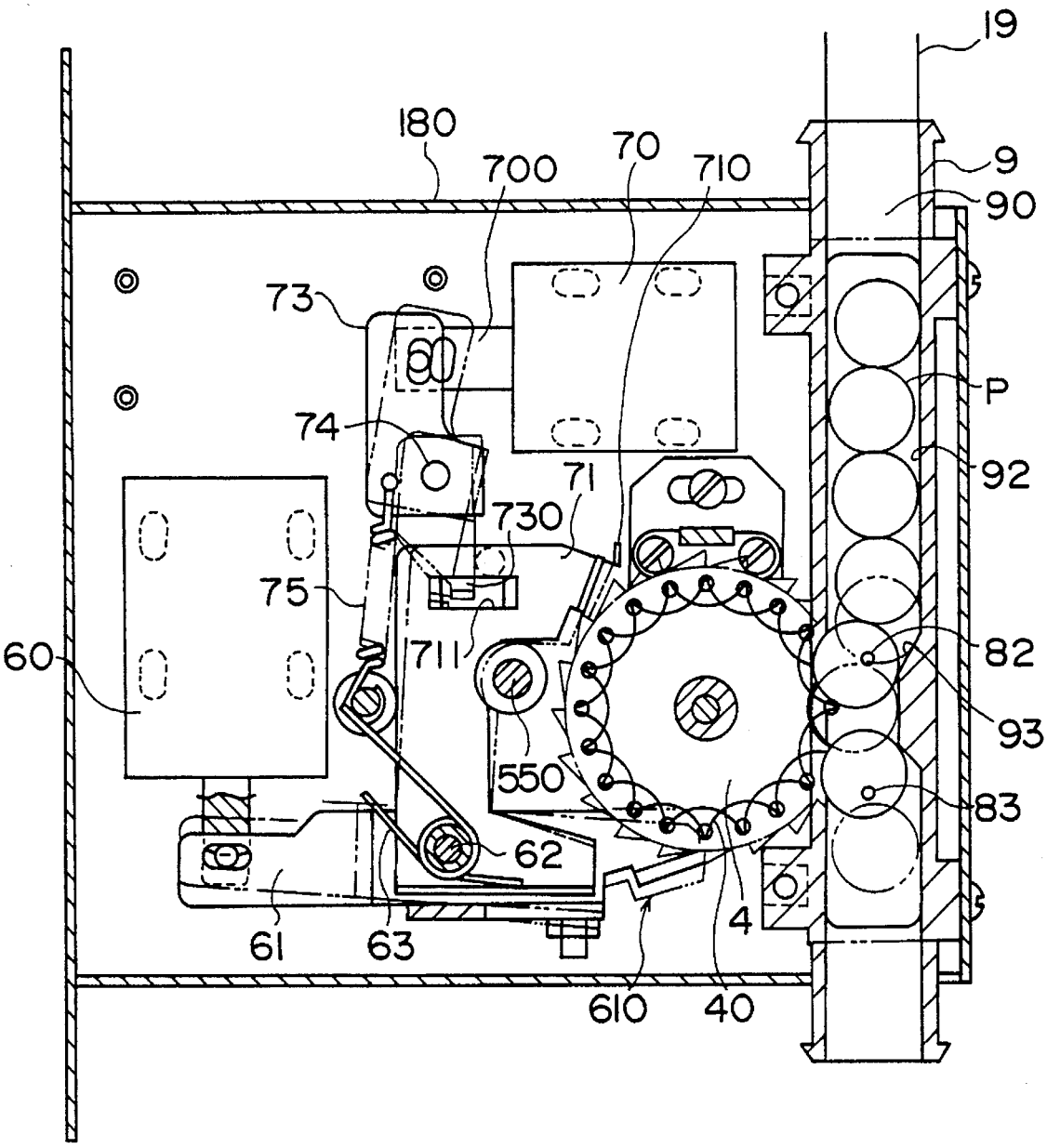
FIG. 12 is a view showing the dispensing apparatus 18 at its operated position.

As a result, the main solenoid 60 and the sub solenoid 70 operate, and the main stopper 61 and the sub stopper 71 will be released from the ratchet wheel to be maintained as shown in FIG. 12. Then, the sprocket 4 continuously rotates at a fast speed by the weight of the pachinko balls, speedily discharging the pachinko balls one after another. However, the rotation of this sprocket 4 is controlled to a maximum speed at which skidding does not occur, by the operation of the governor 55 described earlier.

Furthermore, both the main solenoid 60 and the sub solenoid 70 are operated here, but when the number(N) of prize balls to be dispensed is less than a given number, only the main solenoid 60 may be operated, while the sub solenoid 70 is not.

During dispensing of the pachinko balls, the control/calculating section 20 is counting the number of pachinko balls (from now on referred to as "the dispensed number") H dispensed until then, based on the detecting signal of the detecting means 83. Then, this number is subtracted from the number N of pachinko balls (froth now on referred as "set dispensing number"), and it is decided whether this difference (N–H) has become the previously set minute value (step 202). The minute value is preferred to be 2 to 5. It is 5 in the present embodiment.

As a result of the decision, if the difference is at the minute value, the control/calculating section 20 controls the sub solenoid 70 to be OFF, and the main solenoid 70 is intermittently operated until the dispensing number (N) equals the instructed value (step 203). The intermittent operation can be done by sending a cyclic pulse signal for the main solenoid 60 to the input terminal 216 of the drive circuit 21.

When this kind of intermittent operation is carried out, the main stopper 61 and the sub stopper 71 engages with the sprocket 4 alternately. In this case, the sprocket 4 turns by the angle corresponding to half the concave portion 40, from the time the engagement with the main stopper 61 is released until being engaged with the sub stopper 71. Similarly, the sprocket 4 turns by an angle corresponding to half the concave portion 40, from the time the engagement with the main stopper 71 is released until being engaged with the sub stopper 61. Therefore, as one cycle of an intermittent operation is made, one pachinko ball is dispensed.

When the control/calculating section 20 decides that the dispensing number N has reached the set dispensed number H (yes at step 204), the control/calculating section 20 outputs the ending indication of the main solenoid 60 and the sub solenoid 70 to the drive circuit 21. According to this, the drive circuit 21 controls the transistor 214 and the transistor 215 to be OFF and stops the dispensing. Further, when set dispensed number H has not been reached in step 204, it will go back to the step 203 and the intermittent operation is continued.

Figure 16:
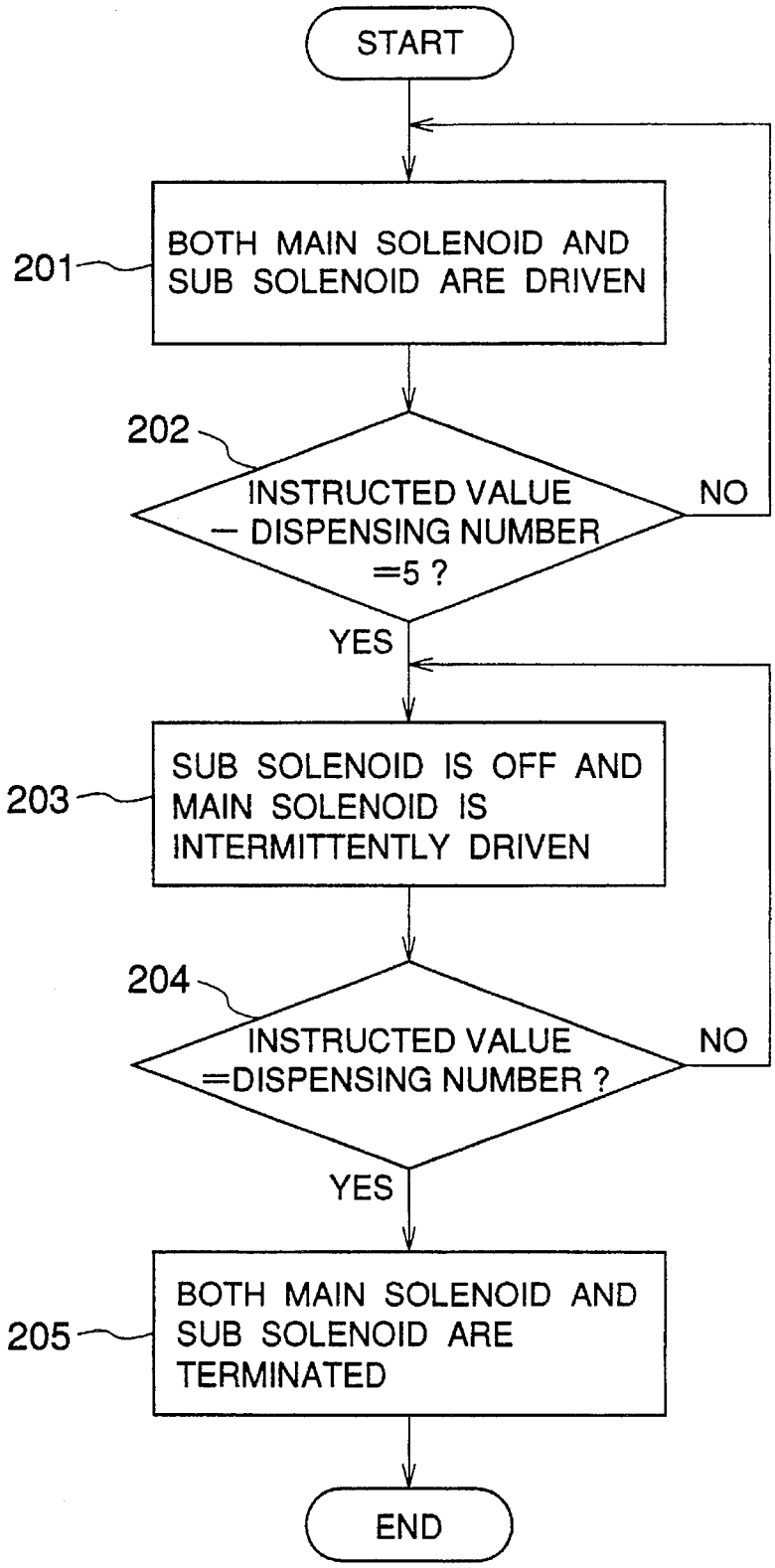
FIG. 16 is a flow chart showing the operation of the control calculation section 20 during dispensing prize balls.

Further, the supply condition of the pachinko balls in the ball path 90 is observed by the control/calculating section 20 according to the output signal of the detecting means 82, although not shown in the flow chart in FIG. 16. In other words, when the supply of the pachinko balls to the ball path 90 is interrupted, the alarm signal is outputted, for some suitable measures to be taken.

Furthermore, the control/calculating section 20 observes whether one pachinko ball is dispensed corresponding to one rotation of the concave portion 40 of the sprocket 4, by comparing the output signal of the detecting means 81 and that of the detecting means 83. Thus, when skidding has occurred in the sprocket 4, this is detected at once, making it possible to cope with.

Although the exchange rate of a medal and the pachinko balls is changed, the slot machine of the present embodiment can cope speedily and easily with the change, as explained above. A new expenditure is not necessary as there are no changes in the parts and so on. Each part does not have to be adjusted because the adaptation is to be done within the control/calculating section using software.

Until the dispensing number N approaches the dispensed number H, the sprocket 4 is rotated continuously by the weight of the pachinko balls. Thus, the pachinko balls can be dispensed continuously at high speed during this time. When the dispensing number N approaches the dispensed number H, it changes to an intermittent operation, and the pachinko balls are dispensed one by one. Therefore, no excess pachinko bails are dispensed because of a delay in stopping the rotation of the sprocket 4. The exact number of pachinko balls according to the direction can be dispensed. Further, as most of the pachinko balls are dispensed at a condition where the sprocket 4 is revolving at a high speed, the dispensing speed as a whole can be high. This kind of characteristic is also useful in making the adjustment in each section unnecessary for the correspondence to the change in exchange rate explained above.

Moreover, high reliability in operation of the main solenoid 60 and the sub solenoid 70 is obtainable by the construction of the drive circuit 21 described earlier. The skidding of the sprocket 4 and ratchet wheel 5 is also prevented by the operation of the governor 55 described earlier. Troubles can be quickly dealt with by the processing based on the detecting result of the detecting means 81 and the detecting means 83.

In the present embodiment, the control/calculating section 20 of the slot machine conducts the control of the dispensing apparatus 18. However, an individual controlling section can be provided on the dispensing apparatus 18 so that control of the main solenoid 60 etc. can be done by the control section. In this case, as for the directions from the control/calculating section 20 to the dispensing apparatus 18 (i.e. the dispensing section 24, the prize ball number counting means 15), not only the direction for dispensing but also the data which shows the number of prize balls to be dispensed is sent.

In the slot machine of the present embodiment, the unit number of the pachinko balls in the game can be changed easily. Thus, it can easily and speedily cope with a change in the exchange rate of the pachinko balls and a medal. No extra expenditure is needed. Further, during dispensing of the pachinko balls, the dispensing speed is sufficiently slowed down just before the dispensing stops. Thus, no machine adjustment of the dispensing apparatus is needed accompanying the change in the exchange rate (note: When suddenly stopping a high speed operation, desired responsiveness cannot be assured. When the ball number to be dispensed becomes small, it may be necessary to adjust the responsiveness).

In the embodiment, the number of pachinko balls taken in for a game is determined by using data of a betting number and a rate value. Thus, it is possible to cope with a new exchange rate by simply changing the setting of the rate value, which makes the operation simple. The number of pachinko balls can be set directly by each selecting switch 16, not by the betting number and the rate value as mentioned. For example, the set data can be stored in the memory 202, based upon the setting such that selecting switch **16*a* corresponds to 5 and selecting switch 16*b* corresponds to 10. However, in this case, the data rewriting operation has to be done for each of the selecting switches 16 (3 times in the above embodiment) to adapt to the change in the exchange rate. Although the difference in the amount of work between the two ways of adaptation is not so large for one slot machine, cumulative difference is rather significant and substantial, because, in general, many slot machines are placed in a game parlor. Thus, if all the exchange rates of the game machine in the game parlor are to be changed, the difference in the overall amount of work and the work efficiency will be great. On the other hand, when the number of pachinko balls are directly set, there is an advantage that a fine setting can be done for each selecting switch 16. For example, it is possible to set the selecting switch 16*a* to correspond to 5, the selecting switch 16*b* to correspond to 9 and the selecting switch 16*c*** to 12. This is useful when the game parlor uses the slot machines on condition that only pachinko balls are used, not considering a game media in a medal form. That is, by selecting the set contents, it is possible to differentiate from other game parlors.

Figure 20:
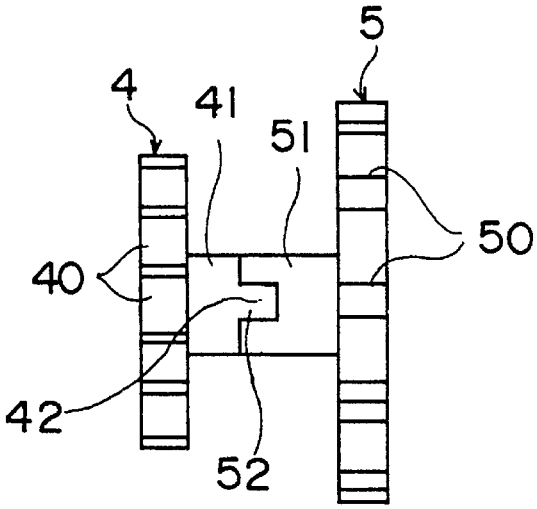
FIG. 20 shows the connection of the sprocket 4 and the ratchet 5.
Figure 21:
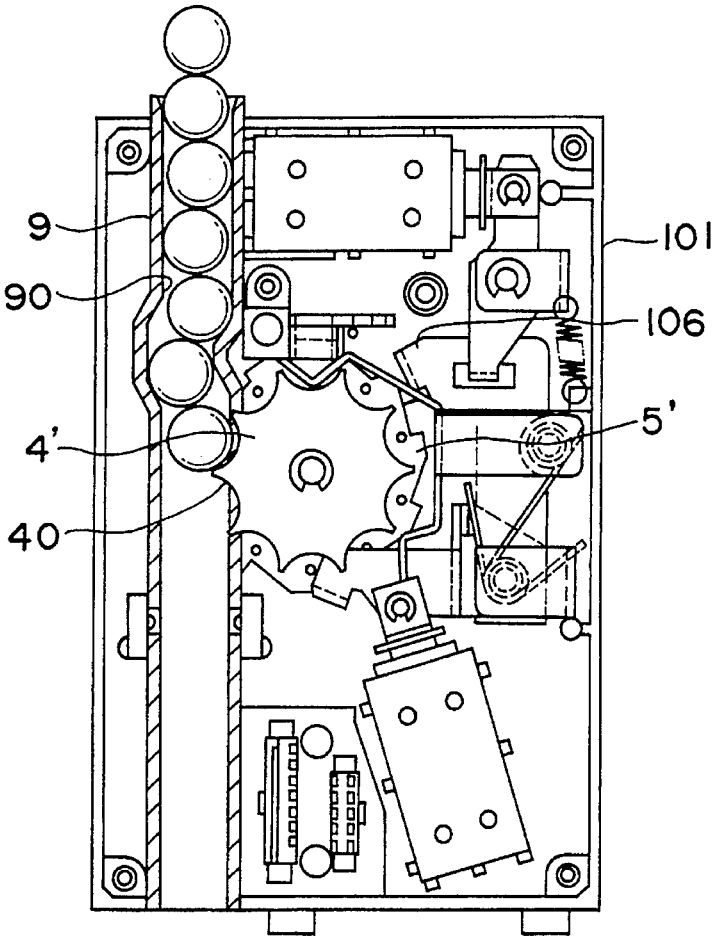
FIG. 21 shows the inside construction of a prior art dispensing apparatus.
Figure 22:
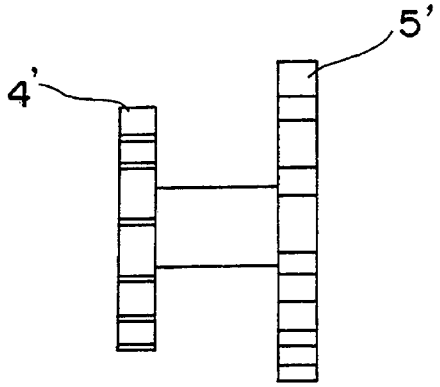
FIG. 22 shows an example of an integral sprocket 4 and ratchet 5 assembly according to a prior art.

Next, the construction for obtaining the second object of the present invention will be explained using FIG. 18 and FIG. 20.

Figure 18A:
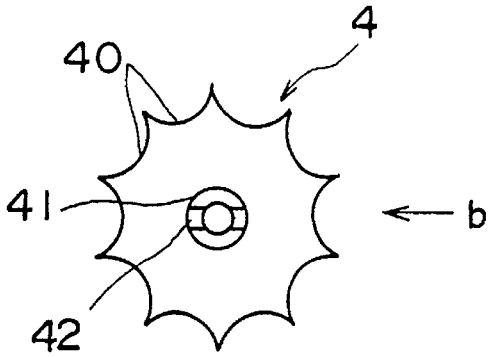
FIG. 18(*a*) is a front view of a sprocket 4.
Figure 18B:
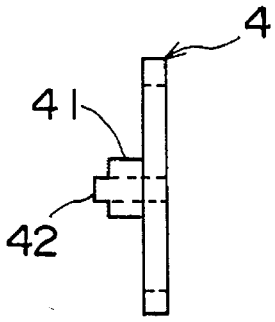
Figure 19A:
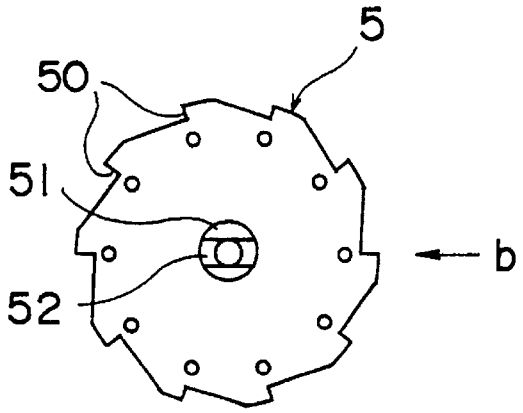
FIG. 19(*a*) is a front view of a ratchet wheel 5.
Figure 19B:
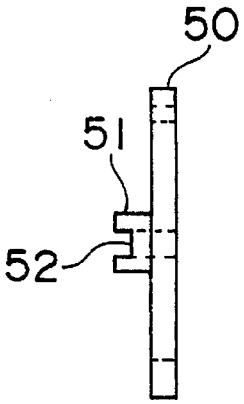

At the tip of the input shaft 41 of the sprocket 4, a fixing projection 42 extending along the center axis of the sprocket is provided (refer to FIG. 18). On the other hand, on the output shaft 51 of the ratchet 5, a groove 52 engageable with the fixing projection is provided (refer to FIG. 19). Thus, as in FIG. 20, by fitting the fixing projection 42 in the groove 52, both will be linked in a condition allowing mutual power communication for conjoint rotation.

Both may be linked during installing onto the apparatus because the linking of both is easy. Therefore, it is not necessary to previously process the sprocket 4 and the ratchet 5 as one body. The setting to the frame body 180 can also be done separately. In this case the sprocket 4 is smaller as compared to these one body constructions, and it does not have any connection with other parts which were previously set on the frame body 180 (for example stoppers 61, and 71). Even if the relative angle position of the sprocket 4 and the ratchet wheel 5 is rotated by 180 degrees, the efficiency of the manufacture will improve, by making the phase relationship (angle) of the concave portion 40 and the cog 50 equal.

In the present embodiment, the fixing projection 42 is provided at the sprocket 4 side while the groove 52 is provided at the ratchet wheel 5 side, but this can be vice versa. The specific form for linking the sprocket 4 and the ratchet wheel 5 is not limited to that of the embodiment.

What is claimed is:

1. A slot machine using pachinko balls as game media comprising:

a selecting means allowing selection of betting numbers each of which has a corresponding relationship with the number of game media used for the game;

a storing means storing a predetermined unit number;

a game playing potion which conducts a game by using the number of pachinko balls calculated based on said unit number and the betting number selected on said selecting means;

a dispensing means which dispenses the number of pachinko balls calculated using said unit number, as a prize, according to the result of said game; and a changing means which changes said unit number.

2. A slot machine according to claim 1, wherein said changing means comprises:

a change instruction inputting means for receiving an instruction to change the unit number and for receiving a new value for the unit number; and a rewrite means for rewriting the unit number stored in said storing means to the new value received when said change instruction inputting means receives the instruction to change the unit number.

3. A slot machine according to claim 2, wherein said change instruction inputting means comprises at least one operation key; and said rewrite means comprises a microcomputer.

4. A slot machine according to claim 2, wherein said changing means further comprises a display means for displaying the new value of the unit number received by said change instruction inputting means.

5. A slot machine according to claim 1, wherein said dispensing means further comprises:

a counting means for counting a dispensed number of pachinko balls and changing the dispensed number in response to the dispensing of pachinko balls; and a means for changing the dispensing speed in accordance with the difference between the dispensed number and the number of pachinko balls calculated.

6. A slot machine according to claim 5, wherein said dispensing means further comprises a predetermined reference value to be referred to when the dispensing speed is changed and for reducing the dispensing speed when the difference between the dispensed number and the number of pachinko balls calculated has a given relationship to the reference value.

7. A pachinko ball dispensing apparatus comprising:

a ball guide which comprises a ball path where the pachinko balls flow;

a sprocket with an axis which is rotatably mounted about the axis and positioned to be operated by the pachinko balls flowing through said ball path; and a ratchet wheel with an axis which is linkable with said sprocket and rotatable about said ratchet axis; the linkage of said sprocket axis and said ratchet axis being releasable.

8. A pachinko ball dispensing apparatus according to claim 7, in which the sprocket axis comprises a projected fixing portion at a side opposite to said ratchet wheel when said sprocket and ratchet wheel are combined; said ratchet axis comprises a fixable concave fixing portion engageable with said projected fixing portion, at a side opposite to said sprocket when said sprocket and ratchet wheel are combined; and the linkage is done by engaging said projected fixing portion with said concave fixing portion.

9. A dispenser for controlling the dispensing of a given number of game balls in a slot machine comprising:

a sprocket rotatably driven by the game balls;

a ratchet wheel disengageably driven by the rotation of the sprocket;

a main stopper disengageably stopping the ratchet wheel rotation;

a sub-stopper disengageably stopping the ratchet wheel rotation;

a main solenoid connected to the main stopper to disengage the main stopper from the ratchet wheel;

a sub-solenoid connected to the sub-stopper to disengage the sub-stopper from the ratchet wheel;

a drive circuit connected to the main solenoid and the sub-solenoid; and a controller connected to the drive circuit which counts the number of game balls dispensed and activates both solenoids to disengage the ratchet wheel for rapid dispensing of game balls until the number of game balls dispensed is within a predetermined number of the given number.

10. The dispenser of claim 9 wherein the controller intermittently activates the main solenoid dispensing the remaining predetermined number of game balls singularly.

11. The dispenser of claim 9 further comprising a governor to limit the maximum rotation speed of the ratchet wheel.

12. A slot machine using pachinko balls as game media and in which the ratio of pachinko balls to an economic value changes, the operation of the slot machine being capable of being altered to compensate for changes in the ratio, said slot machine comprising:

at least one selecting switch to select a betting number representative of the economic value for a given play of the slot machine;

a rewritable memory in which the ratio is stored;

a calculator connected to the selecting switch and to the rewritable memory and comprising a multiplier multiplying the ratio and the betting number to establish a take-in number of pachinko balls;

a variable display viewable by a player and having a changeable pattern representing the results of a given play of the slot machine using the take-in number of pachinko balls;

a dispenser which dispenses a number of pachinko balls as a prize based on the resulting pattern displayed on the variable display for the given play; and an input apparatus connected to the rewritable memory and capable of rewriting the rewritable memory with a new ratio to compensate for changes in the economic value.

13. The slot machine of claim 12 wherein the input apparatus comprises:

a registration key to restrict access to the rewritable memory; and a keypad to enter a new ratio in the rewritable memory after successful access with the registration key.

14. The slot machine of claim 13 further comprising a display connected to the keypad to display the new ratio.

15. The slot machine of claim 12 further comprising:

a second memory storing a starting number of pachinko balls;

a detecting sensor detecting an inserted number of pachinko balls inserted into the slot machine;

the calculator further comprising a counter connected to the sensor counting the inserted number of pachinko balls detected by the detecting sensor and an adder adding the number of inserted pachinko balls to the starting number of pachinko balls to create a total number of available pachinko balls, the calculator storing the total number of available pachinko balls in the second memory; and a first pachinko ball display connected to the calculator displaying the total number of available pachinko balls.

16. The slot machine of claim 15 wherein the calculator further comprises a subtractor subtracting the take-in number from the total number of available pachinko balls stored in the second memory.

17. The slot machine of claim 12 further comprising a second pachinko ball display connected to the calculator, and the calculator calculating a total potential number of prize pachinko balls available in the slot machine as a potential prize, the total potential number being displayed on the second pachinko ball display.

18. A method of operating a slot machine using pachinko balls as a game media wherein a player inserts a desired number of pachinko balls, each pachinko ball having an economic value, the method of operation comprising the steps of:

pre-programming an exchange rate representing the pachinko balls' economic value;

counting the pachinko balls inserted to determine an inserted pachinko ball number;

storing the inserted pachinko ball number in memory;

displaying the inserted pachinko ball number;

calculating and displaying a total number of unused pachinko balls that are available as a prize;

storing a gambling number in memory which the player selects from one of a plurality of selecting switches;

multiplying the gambling number and the exchange rate to establish a take-in number;

changing a pattern of a variable display after the player initiates a slot machine play;

subtracting the take-in number from the inserted pachinko ball number;

updating the inserted pachinko ball number in memory and displaying the updated inserted pachinko ball number;

determining the correct number of prize balls from the new pattern of the variable display and from the exchange rate; and dispensing the correct number of prize balls for that particular play.

19. The method of claim 18 wherein the step of dispensing comprises the steps of:

freely releasing prize balls at a high speed until a predetermined number of prize balls remain to be dispensed; and restricting dispensing of the remaining predetermined number of prize balls.

20. The method of claim 19 further comprising the step of controlling the maximum speed of discharging prize balls to prevent the prize balls from skidding.

21. The method of claim 19 further comprising the step of sensing the discharge of prize balls and activating an alarm if an expected prize ball does not discharge.

22. A method of changing an exchange rate value of a slot machine using an economically valued game media comprising the steps of:

monitoring a keypad for an input;

distinguishing a registration key input from another keypad input;

temporarily storing and displaying a value associated with another keypad input other than a registration key input;

changing the exchange rate value in response to a registration key input and the temporarily stored value.

23. A method of changing an exchange rate value in a memory of a slot machine using an economically valued game media comprising the steps of:

monitoring a keypad for an input;

distinguishing a registration key input from another keypad input;

allowing access to the memory in response to a correct registration key input;

changing the exchange rate value in memory according to a keypad input representing a new exchange rate value.

24. The method of claim 23 further comprising the step of displaying the new exchange rate value means.

* * * * *